United States Patent [19]

Hasserjian

[11] 4,419,814

[45] Dec. 13, 1983

[54] METHOD OF MAKING A BOBBIN CONSTRUCTION FOR AUTOTRANSFORMER BALLAST

[75] Inventor: Simon Hasserjian, Willowdale, Canada

[73] Assignee: General Signal Corporation, Stamford, Conn.

[21] Appl. No.: 311,568

[22] Filed: Oct. 15, 1981

[51] Int. Cl.[3] ..... H01F 41/06

[52] U.S. Cl. ..... 29/605; 336/171; 336/198

[58] Field of Search ..... 29/605; 242/7.03; 336/198, 208, 170, 171

[56] References Cited

U.S. PATENT DOCUMENTS

| | | | |
|---|---|---|---|
| 3,979,707 | 9/1976 | Prince, Jr. | 336/198 X |
| 4,023,262 | 5/1977 | Miknaitis | 29/605 |
| 4,183,002 | 1/1980 | Haslau | 336/198 X |

*Primary Examiner*—Carl E. Hall

*Attorney, Agent, or Firm*—Milton E. Kleinman; John F. Ohlandt

[57] ABSTRACT

A method of fabricating an autotransformer ballast and the unique ballast resulting therefrom are disclosed; the method comprising forming a single bobbin for accommodating a main primary winding and a main secondary winding, each having a large number of turns, and additional, filament windings, each having a number of turns much smaller than the turns of said first and second main windings; the bobbin being defined by a tube adapted to accommodate a core, the tube being divided into sections along its longitudinal axis for receiving the respective windings; the method further comprising the steps of continuously forming the windings around the bobbin with wire of the same size for all of the said windings.

1 Claim, 10 Drawing Figures

FIG.1
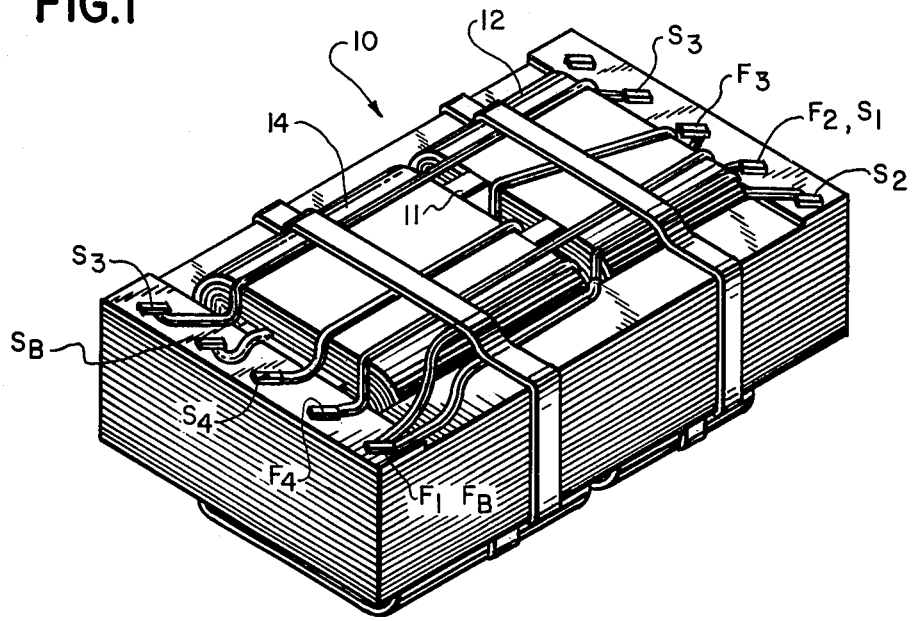
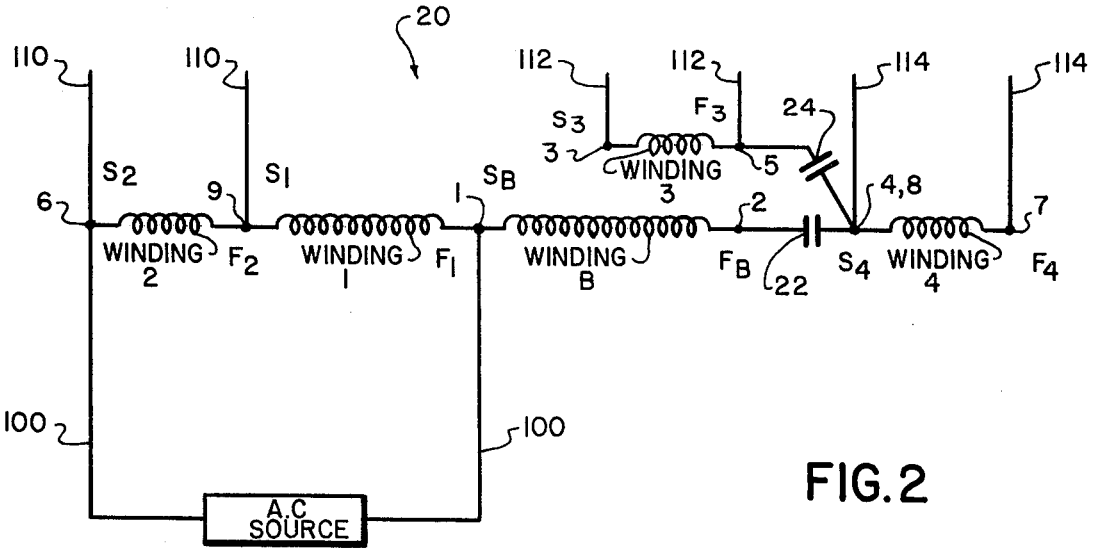
FIG.2

FIG.3
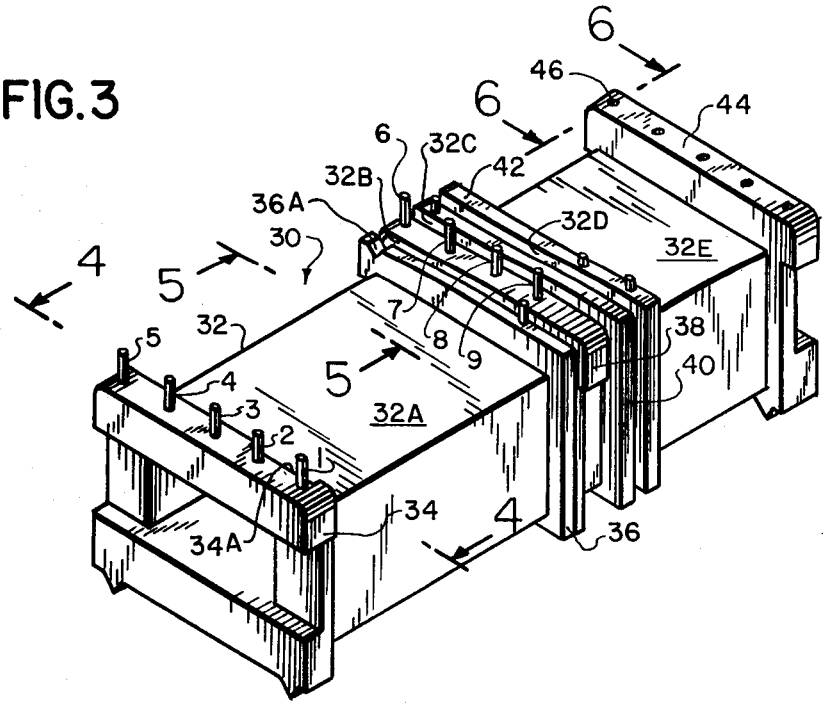
FIG.4
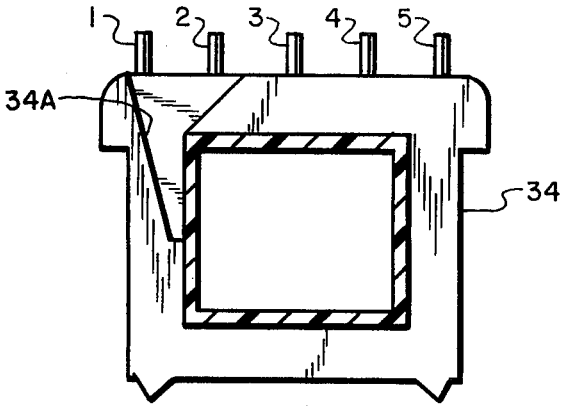
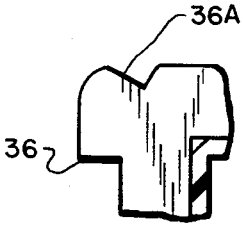
FIG.5
FIG.6
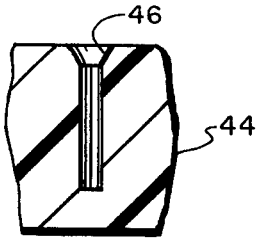

METHOD OF MAKING A BOBBIN CONSTRUCTION FOR AUTOTRANSFORMER BALLAST

BACKGROUND OF THE INVENTION

The present invention pertains to transformer ballasts for supplying power in suitable form to gaseous discharge devices or the like, and particularly to a construction for an autotransformer ballast whereby a single bobbin may be utilized in fabricating the whole ballast.

In order to provide background material so that the context and applicability of the invention may be fully appreciated, reference may be made to the following U.S. Pat. Nos. 3,247,422 and 3,371,244. In the former, an invention is disclosed involving a transistor inverter ballasting circuit in which an autotransformer is utilized for ballast purposes. A plurality of four windings are incorporated in the autotransformer, one of which serves as a primary and the four windings together constitute the secondary; the load circuit connected across the primary secondary includes a current limiting impedance in the form of a capacitor, and a gaseous discharge lamp. A detailed circuit description in U.S. Pat. No. 3,247,422 refers to the four windings as being constituted of entirely different wire sizes and, of course, having a variety of different turns for the windings. The core described therein is a molybdenum permaloy toroid.

The other reference cited above, namely, U.S. Pat. No. 3,371,244 discloses a ballast circuit for discharge devices such as ultraviolet lamps and indicates a preferred construction for its ballast transformer as involving an open magnetic flux path, and in which the core comprises a stack of rectangular laminations resulting in a core in the form of a straight bar. Such open magnetic flux path construction provides the necessary leakage inductance so that the secondary winding can serve as the ballast for a gaseous discharge tube. As before with U.S. Pat. No. 3,247,422, a variety of different size wires are contemplated for the plurality of windings of the transformer.

The most pertinent known construction is that developed by applicant's assignee, which is depicted in FIG. 1 of the drawing. Such construction will be described in detail hereinafter. Suffice it to say here that the autotransformer involved is for the purpose of supplying power to two 40 watt, 120 volt fluorescent lamps, the autotransformer featuring a main primary winding of a particular wire size, and a main secondary winding of a different wire size connected in series with the first main winding. Additionally, three windings with a much smaller number of turns than the first main and second main windings serve to heat the filaments of the fluorescent lamps. The three filament windings are normally wound on the last layer of the first main winding.

SUMMARY OF THE INVENTION

Although the several known forms of construction for transformer ballasts have their virtues and advantages, a fundamental drawback in the fabrication of such transformers has been the necessity to wind at least the secondary winding as an independent operation from the other winding or windings since, as has been explained above, an entirely different wire size has been utilized for such secondary or, as it will be referred to hereinafter, the main secondary winding.

Accordingly, it is a primary object of the present invention to avoid the need for forming the main secondary winding independently of the other windings and instead, to enable the use of a single wire size throughout the transformer ballast. Of necessity the primary, secondary, and common section, currents are appropriately adjusted so as to obtain values permitting the use of a single wire size throughout. This aspect will be discussed more fully hereinafter.

In attainment of the aforenoted object, it is a primary feature of the present invention to provide a method of fabrication an autotransformer ballast by (1) forming a single bobbin for accommodating a main primarily winding and a main secondary winding, each having a large number of turns; and for accommodating additional, filament windings, each of these having a number of turns much smaller than the turns of the main windings: the bobbin being defined by a tube adapted to accommodate a core and divided into sections along its longitudinal axis for receiving the respective windings; and (2) including the further step of forming said windings around said bobbin using wire of the same size for all of said windings.

A further primary feature resides in the autotransformer ballast itself which results from the aforenoted method.

An ancillary or accompanying feature involves the adjustment of the length of laminations when compared with devices known in the art. Thus the length is so adjusted as to eliminate the shunt that has conventionally been employed; by such elimination the single bobbin construction is made feasible.

Yet another feature relates to adjustment of the gap or slot normally formed in relation to the secondary winding so that the required saturation can still be obtained.

Another aspect of the present invention relates to the method of fabricating the autotransformer ballast and particularly to the sequence of winding of the individual sections of the bobbin. The sequence is chosen such that the continuous formation of windings from wire of one size can be realized. Moreover, there is enabled the winding around, and subsequent connection to, terminal pins that are upstanding in two separate rows on given dividers which define the winding sections. This sequence will be provided in detail hereinafter.

An important advantage of the present invention is that the completed single bobbin with a completely finished and properly connected series of windings is ready for assembly to other circuit elements, particularly to a pair of capacitors normally used with a ballast. Also, the assembly to the magnetic circuit is greatly facilitated because of the single bobbin construction. Thus, a number of assembly steps found necessary with prior art constructions are obviated.

Other and further objects, advantages and features of the present invention will be understood by reference to the following specification in conjunction with the annexed drawing, wherein the like parts have been given like numbers.

BRIEF DESCRIPTION OF DRAWING

FIG. 1 is a top plan view of a construction of a known transformer ballast.

FIG. 2 is an electrical schematic diagram illustrating the electrical connections of the several windings and of other components.

FIG. 3 is a perspective view of the single bobbin construction of the present invention, before any windings have been applied.

FIG. 4 is a sectional view taken on the line 4—4 of FIG. 3.

FIG. 5 is a sectional view taken on the line 5—5 of FIG. 3, and particularly illustrating a groove that is formed in one of the dividers.

FIG. 6 is a sectional view taken on the line 6—6 of FIG. 3, and particularly illustrating a receptacle for one of the terminal pins.

DESCRIPTION OF PREFERRED EMBODIMENT

Figure 7:
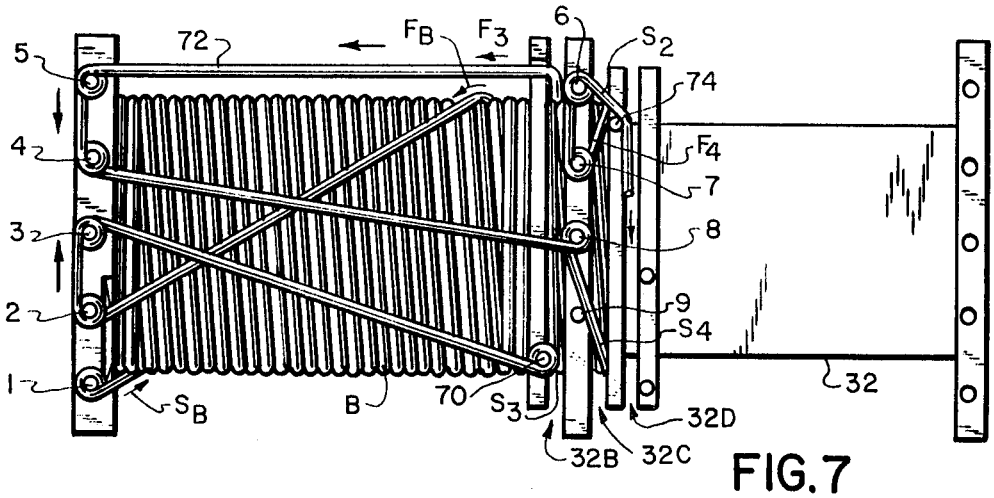
FIG. 7 is a top plan view of the bobbin previously illustrated in FIG. 3, but showing the completion of the first few windings on the bobbin.

Referring now to the figures of the drawing, and particularly, for the moment, to FIG. 1, there will be seen a known transformer ballast construction. In accordance with this construction, the autotransformer ballast 10 seen in FIG. 1 is adapted to supply power in a specific configuration to two 40 watt 120 volt fluorescent lamps. The primary side of the autotransformer is seen on the right, designated 12, and the secondary side is designated 14.

The principal or main winding on the secondary side 14 is designated winding B and is connected to the terminals $F_1$, $F_B$, and $S_B$; whereas, all of the other windings are wound on the primary side 12, connections thereto being made by means of the other designated terminals. However, unlike the present invention to be described, the making of these connections requires a separate assembly operation, that is, one entirely distinct from the coil winding operation.

In conventional manner, the core under the secondary winding is bridged with a gap to obtain saturation; and a shunt 11, seen in FIG. 1, between the primary and the secondary winding, provides inductance for the secondary circuit.

Referring now to FIG. 2, there is seen an electrical schematic diagram for the transformer ballast configuration in accordance with the present invention. However, this electrical configuration is virtually identical to that for the known transformer ballast 10, except for the fact that the start and finish points for the winding B are reversed. Thus, it will be seen in the electrical configuration of the present invention (FIG. 2), that the start of winding B, designated $S_B$, is at the same point (terminal pin 1) as the finish $F_1$ of winding 1. Hence the joint designation $F_1S_B$ in FIG. 2; whereas $F_1F_B$ is the designation used with the autotransformer ballast of FIG. 1; that is to say, the designation for the lowermost terminal on the left.

Also, it should be noted that for the description of the present invention, specific terminal pin numbers, which will be referred to later in connection with other figures, are seen in FIG. 2. The reason for the pin numbers 4 and 8 being applied to the point marked S4 is that suitable connection must be made to a capacitor physically located at a remote point from pin 8.

Power is supplied by means of conductors 100 to the primary side of the autotransformer ballast 20 of the present invention seen in FIG. 2. Likewise, as is standard practice in the art, the lamp load is connected across the conductors designated 110 and 114 at the left and right extreme ends respectively of the total secondary, which includes all of the windings. It will also be understood that the three filament windings designated winding 3, winding 4 and winding 2 are connected by their pairs of conductors, that is, the respective pairs marked 112, 114, and 110, to the filaments of the fluorescent lamps. Also connected in the diagram of FIG. 2 are capacitors 22 and 24 for well understood purposes. The total primary side includes the main primary winding, or winding 1, as well as the filament winding labelled winding 2.

The unique manner in which the autotransformer ballast 20 is formed, and the particularities of the bobbin construction, can be appreciated by referring now to FIGS. 3 through 9A of the drawing. In FIG. 3 there is illustrated an extended single bobbin 30, such bobbin being defined by a tube 32 adapted to accommodate a core 80 (seen in FIG. 9). The tube 32 is divided into five sections spaced along its longitudinal axis for receiving the respective windings for the autotransformer ballast.

In the specific embodiment illustrated, the autotransformer 20 includes five windings, a main primary winding on the primary side consisting of 835 turns, a main secondary winding, or B winding, consisting of 1340 turns, a filament winding or coil, designated winding 3, in FIG. 2, consisting fof 35 turns, filament winding 4 consisting of 35 turns and filament winding 2 consisting of 33 turns. The wire size, which is the same for all of the windings, is No. 27½. The number of turns in each winding of the stack were selected to provide adequate open circuit voltage, lamp operating current, etc., in accordance with the lamp specifications.

The main secondary winding, which has the largest number of turns, is accommodated in the section 32A of the tube 32 defining bobbin 30. Filament winding 3 is accommodated in the section 32B, filament winding 4 in 32C, filament winding 2 in 32D, and the main primary winding, or winding 1, in section 32E. The several sections indicated are bounded by respective pairs of the dividers 34, 36, 38, 40, 42, and 44, such individual dividers having a larger cross sectional area than the tube 32. A cut-out portion 34A is provided at the inner surface of divider 34 to serve as a guideway in the wire winding procedure. Likewise, a groove 36A is formed in the divider 36 to serve as a wire guide.

A plurality of terminal pins are formed on the top of the bobbin case 30. These are attached in spaced-apart relationship in two groups. Five pins, designated pins 1 through 5 in front-to-back order, are arranged in the first group on the top of divider 34. The second group, designated pin 6 through pin 9, is arranged in reverse order on the top of divider 38. Suitable holes 46 to accommodate the terminal pins are formed in the dividers.

Figure 9:
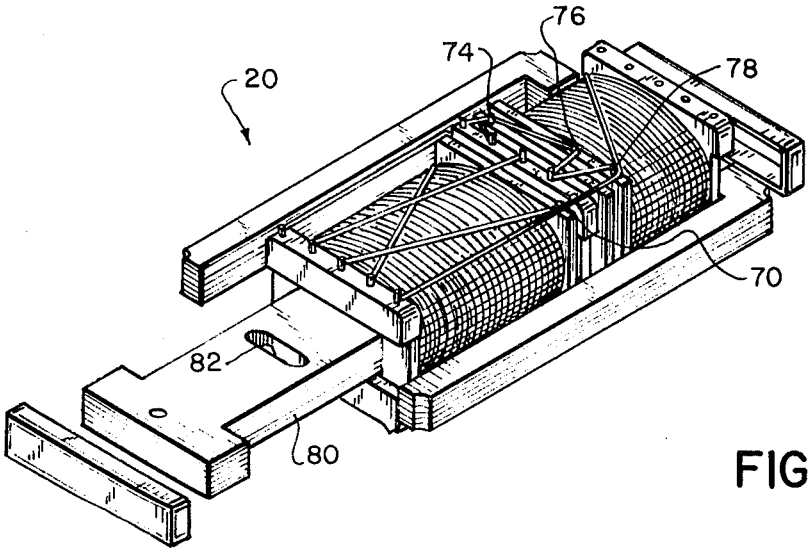
FIG. 9 is an exploded perspective view of the entire autotransformer ballast, including ancillary components.
Figure 9A:
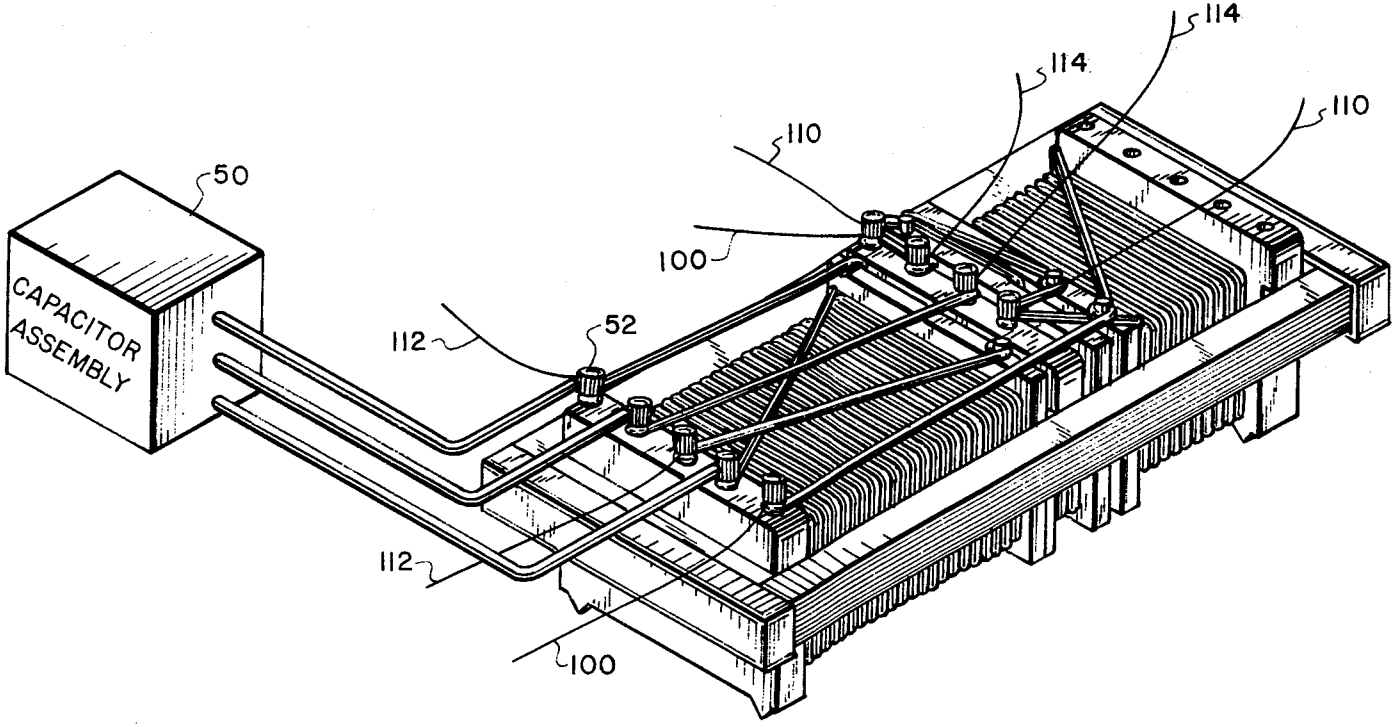
FIG. 9A is a perspective view of the completed circuit package, particularly illustrating circuit connections to other components.

The electrical connections to the fluorescent lamps, and from the power source to the terminal pins, are indicated by the linens seen in FIG. 9A. These connections, of course, correspond with those seen in the schematic diagram of FIG. 2. It is to be noted that the capacitor assembly 50 of FIG. 9A includes the two capacitors 22 and 24 of FIG. 2; and the assembly is appropriately coonnected by terminal lugs 52, to the respective pins 5, 4, and 2. The other connections are made to other terminal lugs fastened on their corresponding terminal pins.

The actual winding operation can best be understood by reference to FIG. 7 in which several of the windings have been formed. Thus winding B begins from terminal pin 1 as indicated by the arrow SB, ending with the arrow FB which returns to terminal pin 2. The winding is continued, preferably by an automated machine arrangement, such that the wire is next wrapped around terminal pin 3, thence around a first support post designated 70. Thereafter the winding of filament winding No. 3 in section 32B is commenced. After filament winding No. 3 has been completed, the wire 72 is taken to pin No. 5; thence, around this pin to terminal pin 4 around which it is likewise wrapped. Thereafter, the procedure is to carry the wire around terminal pin 8 in the second group of pins. From pin 8, the fourth filament winding is begun as indicated by the symbol S4, such winding terminating at F4, at which point the wire is wrapped around terminal pin 7. The wire is next wound around terminal pin 6 and then partly around the integral plastic post 74. This marks the beginning of the winding of the final filament winding 2 as indicated by the symbol S2.

Figure 8:
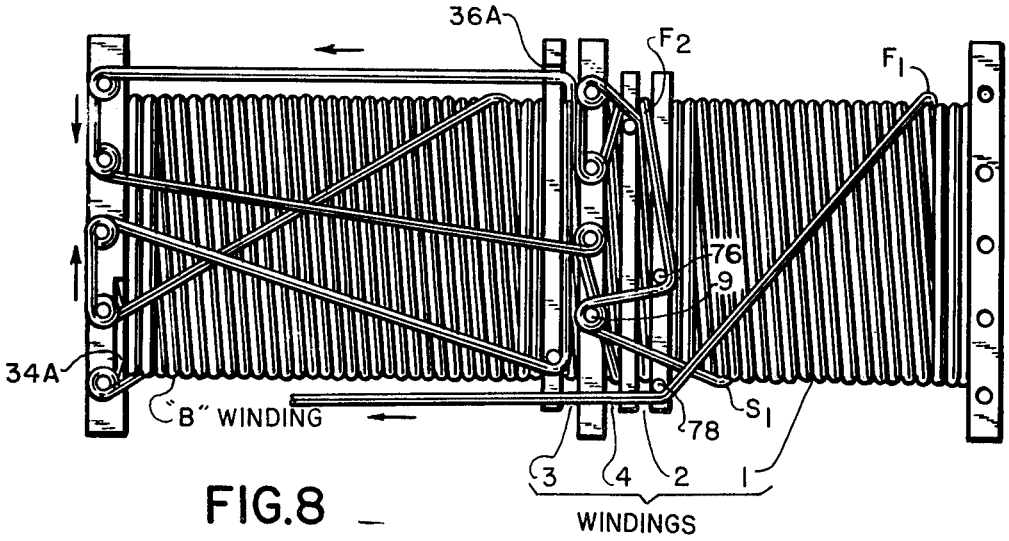
FIG. 8 illustrates the later stages in the winding process, particularly the end point in such process.

FIG. 8 illustrates the continuation of the winding operation, the additional figure being provided in order to insure clarity. The ending of filament winding 2 is denoted by the symbol F2; and it will be seen that the wire is brought around the post 76; thence to terminal pin 9 with a wrap-around of that pin. At this point the winding of the main primary winding, or winding 1, is begun, as indicated by symbol S1, and is completed at the point F1. Thereafter, the wire is brought around the post 78; and finally the process is terminated at the point of beginning by connecting the end of the wire to terminal pin 1.

Accordingly, the winding of all five windings is now completed and it remains only to cut certain portions of the wires between terminal pins in order to achieve the electrical configuration precisely as depicted in FIG. 2. Thus, the wire is cut between the fourth and fifth pins, with the result as seen in FIG. 9, appropriate soldering of the wrapped wire to the terminal pins being performed. Likewise, the wire is cut between the second and third pins; the result of this is also seen in FIG. 9; and between the sixth and seventh pins.

The autotransformer ballast per se is completed by inclusion of the magnetic circuit seen in FIG. 9, including the core 80 having the requisite gap or slot 82 for obtaining the desired leakage characteristic. It will be understood that the completed autotransformer ballast is then suitably mounted in a circuit package which includes the capacitor assembly and the requisite connections already noted by reference to FIG. 9A.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

What is claimed is:

1. A method of fabricating an autotransformer ballast comprising the steps of:

(1) forming a single bobbin for accommodating a main primary winding and a main secondary winding, each having a large number of turns, and additional filament windings, each having a number of turns much smaller than the turns for the main winding;

(2) said bobbin being defined by a tube adapted to accommodate a core, said bobbin being divided into sections along its longitudinal axis for receiving the respective windings;

(3) further comprising the step of forming individual transverse dividers having a larger cross sectional area than said tube, thereby providing discrete bounded sections for the respective windings;

(4) forming terminal pins upstanding from certain ones of said dividers so as to enable electrical connections from said windings while permitting continuously forming the windings, said terminal pins being formed in two aligned groups spaced along individual dividers;

(5) and, in which the windings, which are designated the main secondary winding, filament windings 3, 4, and 2, and main primary winding are formed and spaced in order along the longitudinal axis of said bobbin, being continuously formed with respect to the terminal pins, which are designated the first pin through fifth pin for the first group in front-to-back order, and sixth pin to ninth pin for the second group in reverse order; in accordance with the following.

starting at the first terminal pin in the first group of pins, winding the main secondary or B winding, continuing by wrapping around the second pin of the first group, thence around the third pin, thence around a first support post; thereafter winding filament winding three, thence proceeding around the fifth terminal pin, thence the fourth pin, thereafter the eighth pin of the second group of pins;

from the eighth pin, winding filament winding four, continuing around the seventh pin, thence the sixth pin, and around a second support posts; thence, winding the filament winding two, thence proceeding around a third support and then the ninth pin; thence winding the first main winding, continuing around a fourth support post to terminate at the point of beginning;

thereafter, cutting the wire between the second pin and the third pin, between the fourth pin and the fifth pin, whereby the desired electrical configuration is obtained.

* * * * *